United States Patent [19]

Lonati

[11] Patent Number: 5,056,339

[45] Date of Patent: Oct. 15, 1991

[54] PROCESS AND DEVICE FOR PRODUCING DESIGNS ON STOCKING IN TWIN-CYLINDER CIRCULAR KNITTING MACHINE

[75] Inventor: Francesco Lonati, Brescia, Italy

[73] Assignee: Lonati S.p.A., Brescia, Italy

[21] Appl. No.: 349,541

[22] Filed: May 9, 1989

[30] Foreign Application Priority Data

May 18, 1988 [IT] Italy ..... 20632 A/88

[51] Int. Cl.[5] ..... D04B 15/60

[52] U.S. Cl. ..... 66/134; 66/133; 66/222

[58] Field of Search ..... 66/133, 134, 140 S, 66/149 S, 9 R, 222, 140 R

[56] References Cited

U.S. PATENT DOCUMENTS

| | | | |
|---|---|---|---|
| Re. 25,101 | 12/1961 | Philip | 66/133 |
| 3,066,512 | 12/1962 | Moody | 66/134 |
| 3,359,759 | 12/1967 | Mattingly et al. | 66/133 |
| 3,387,468 | 6/1968 | Mattingly et al. | 66/133 |
| 3,605,444 | 9/1971 | Lonati | 66/133 |
| 3,935,718 | 2/1976 | Carminati | 66/9 R |
| 4,522,042 | 6/1985 | Casstevens et al. | 66/140 S |
| 4,665,720 | 5/1987 | Beconcini et al. | 66/149 S |
| 4,689,971 | 9/1987 | Conti et al. | 66/139 |
| 4,709,563 | 12/1987 | Camicotti et al. | 66/222 |
| 4,718,254 | 1/1988 | Lonati | 66/222 |
| 4,841,748 | 6/1989 | Watanabe et al. | 66/140 R |

FOREIGN PATENT DOCUMENTS

| | | | |
|---|---|---|---|
| 1254808 | 11/1967 | Fed. Rep. of Germany | 66/133 |
| 1191828 | 5/1960 | United Kingdom | 66/133 |

*Primary Examiner*—Werner H. Schroeder
*Assistant Examiner*—John J. Calvert
*Attorney, Agent, or Firm*—Guido Modiano; Albert Josif

[57] ABSTRACT

In the process a first thread differing in color with respect to a second thread which constitutes the stocking is fed by a thread guide alternatively to the second thread to a preset number of needles during the formation of a row of stitches. The first thread, which constitutes the design, is cut proximate to the ends of the portion of the row knit by the preset number of needles and the ends of the thread are moved towards the inside of the needle cylinders by means of a flow of air.

13 Claims, 3 Drawing Sheets

PROCESS AND DEVICE FOR PRODUCING DESIGNS ON STOCKING IN TWIN-CYLINDER CIRCULAR KNITTING MACHINE

BACKGROUND OF THE INVENTION

The present invention relates to a process and a device for producing designs on stockings in twin-cylinder circular knitting machines.

As known, designs may be provided on stockings manufactured with twin-cylinder circular machines either by means of hand-made embroidery, or by sewing the ornamental design onto the stocking or by printing.

In single-cylinder machines, the designs are generally produced directly by the machine during the forming of the stocking by feeding a preset number of needles with a thread differing in color with respect to the thread which constitutes the remaining part of the stocking, i.e. the background of the design. At the end of the knitting of the portion of row related to the design, the thread is cut by a rotating cutter arranged coaxially to the needle cylinder in the needles' work area.

A design with one or more colors differing from the background color of the stocking can be easily produced directly during the forming of the stocking in single-cylinder machines, but such a design is difficult to obtain in twin-cylinder machines. In twin-cylinder machines it is in fact impossible to place a rotating cutter in the needles' work area, since said cutter would interfere with the product being formed.

SUMMARY OF THE INVENTION

The aim of the present invention is to solve the above described problem by providing a process which produces designs on stockings in a simple and reliable manner, using a thread differing in color with respect to the remaining part of the stocking, during the forming of said stockings with twin-cylinder circular knitting machines.

Within the scope of this aim, an object of the invention is to provide a process which produces well finished designs of good quality.

Another object of the invention is to provide a device which can be applied in a simple manner to twin-cylinder circular knitting machines to perform said process.

This aim, as well as these and other objects which will become apparent hereinafter, are achieved by a process for producing designs on stockings in twin-cylinder circular machines, characterized in that a first thread, differing in color with respect to a second thread which constitutes a stocking, is fed by a thread guide to a preset number of needles alternatively to said second thread during formation of a row of knitting, said first thread constituting a design and being cut proximate to ends of a portion of a row knit by said preset number of needles, the ends of said thread being moved towards the inside of the needle cylinders by a flow of air.

The process according to the invention can be performed by means of a device which is characterized in that it comprises a thread guide which is controllably movable, in a radial direction with respect to the needle cylinders, from an inoperative position, in which its thread delivery end is spaced from the needle work area, to an operative position, in which said delivery end is proximate to said needle work area to feed a preset number of needles with a first thread for forming a design, means for cutting and retaining said first thread being arranged downstream of said thread guide according to the direction of rotation of said needle cylinders; controllably actuatable means for delivering a jet of air being provided proximate to the delivery end of said thread guide and said cutting and retention means for said first thread to convey the free ends of the portion of said first thread, knit by said preset number of needles, towards the inside of the needle cylinder.

BRIEF DESCRIPTION OF THE DRAWINGS

Further characteristics and advantages of the invention will become apparent from the description of a preferred but not exclusive embodiment of the process according to the invention and of the device for carrying out the process, illustrated only by way of non-limitative example in the accompanying drawings, wherein.

DESCRIPTION OF THE PREFERRED EMBODIMENTS

Figures 1, 7, 8:
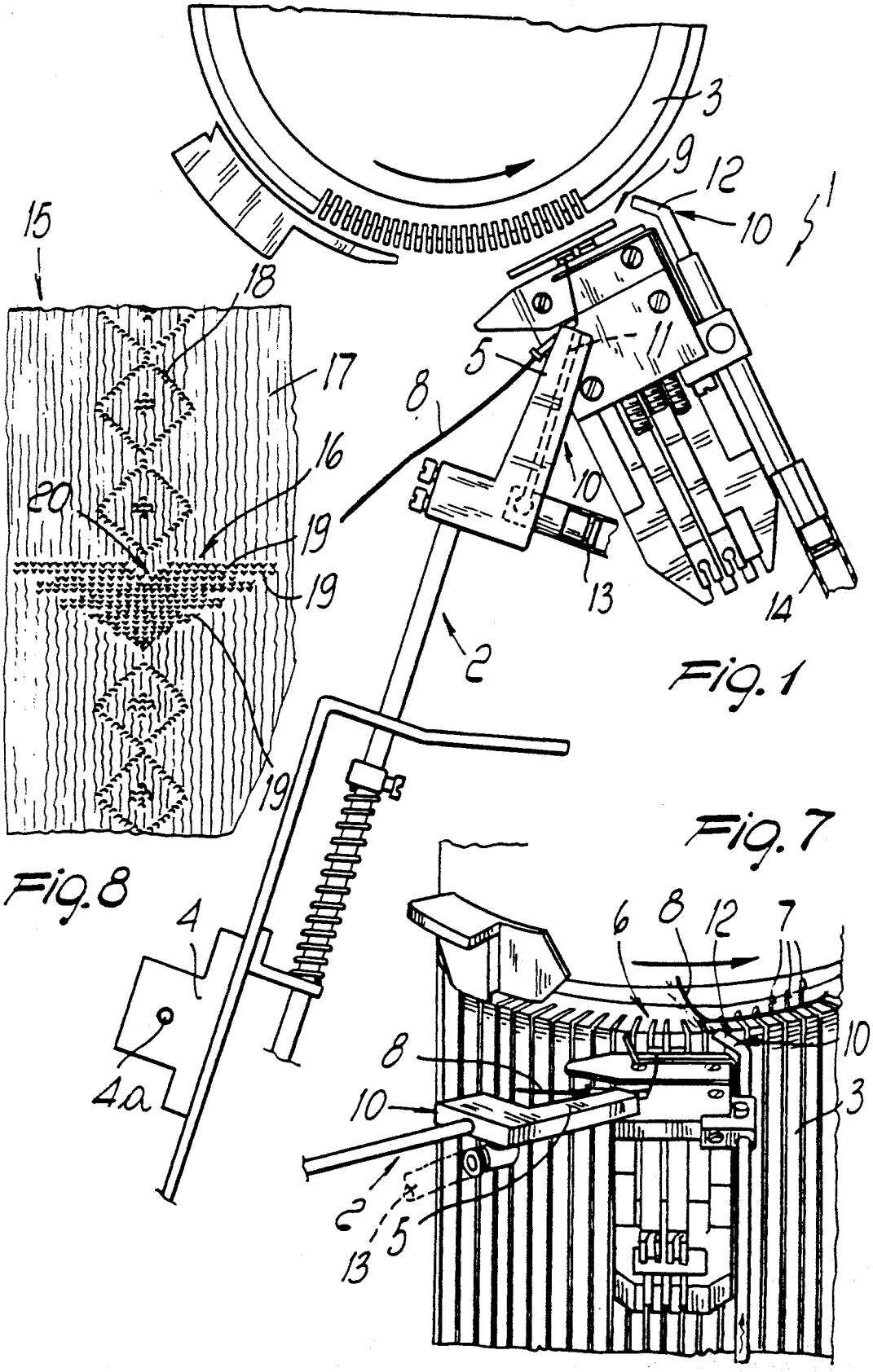
FIG. 1 is a schematic top plan view of a twin-cylinder circular knitting machine, illustrating the arrangement of the thread guide for carrying out the process according to the invention.
FIG. 7 is a perspective view of the process step illustrated in FIG. 6.
FIG. 8 is a view of a portion of a stocking manufactured with a twin-cylinder circular knitting machine with an example of a design which is carried out with the process according to the invention.

With reference to the above described figures, the device for performing the process according to the invention, generally indicated by the reference numeral 1, substantially comprises a thread guide 2 which is arranged laterally to the needle cylinders 3 and is mounted on a support 4 pivotally connected to the machine's supporting structure about an axis 4a which is parallel to the axis of the cylinders 3.

In this manner the thread guide 2 can oscillate about the axis 4a from an inoperative position, in which its delivery end 5 is spaced from the work area 6 of the needles 7, to an operative position, in which said end 5 is proximate to the work area 6 of the needles 7, to feed a preset number of needles, which are moved to knit, with a first thread 8 to form a design. Known pneumatic or mechanical actuators, controlled by a control element, for example an electronic control element, which supervises the various operations of the machine, may be used to move the thread guide 2 from its operative position to its inoperative position or vice versa.

Means 9 for cutting and retaining the thread 8 are arranged downstream of the thread guide 2 according to the direction of rotation of the cylinders 3, indicated by an arrow in the drawing figures; said means are constituted by a clamp and by a blade commoly used in these machines to cut the reinforcement threads inserted in the stocking, for example at the heel.

Air delivery means 10 are conveniently provided proximate to the delivery end 5 and proximate to the cutting and retention means 9; said means are controllably activated in a per se known manner by the control element which supervises the various operations of the machine.

Said air delivery means 10 are constituted by a first nozzle 11 which is provided directly in the delivery end 5 of the thread guide 2 and is oriented radially to the cylinders 3 when the thread guide is in its operative position. The air delivery means 10 furthermore comprise a second nozzle 12 which is associated with the clamp-blade assembly 9 and is also oriented substantially radially towards the inside of the cylinders 3. The nozzles 11 and 12 are fed by flexible conduits 13 and 14 which are connected to a source of compressed air through known valve means, not illustrated for the sake of simplicity, which are actuated by said control element.

The means for cutting and retaining the thread 8 are also actuated in a known manner by the control element, similarly to what occurs in conventional machines in order to cut and retain a reinforcement thread.

The operation of the device in the execution of the process according to the invention is as follows.

During the forming of the parts of the stocking which are not affected by the design, the thread guide 2 is kept in its inoperative position, as illustrated in FIG. 1, and the machine is actuated in a conventional manner by feeding the needles with a thread which constitutes the background of the design. Said thread is fed to the needles by means of a thread guide arranged proximate to a feed of the machine.

Figure 2:
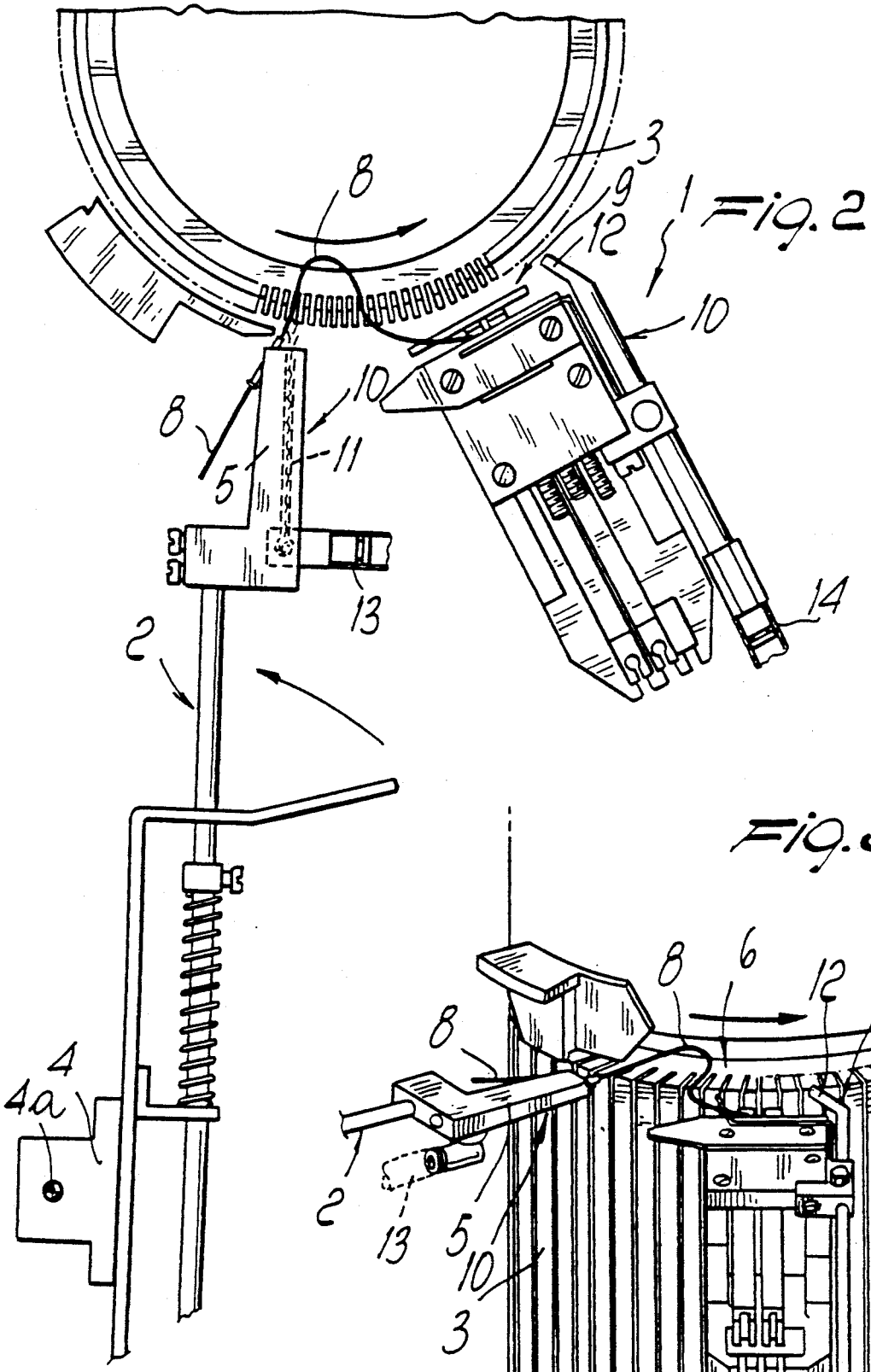
FIG. 2 is a view similar to FIG. 1, illustrating the initial step of knitting a row of the design.
Figure 3:
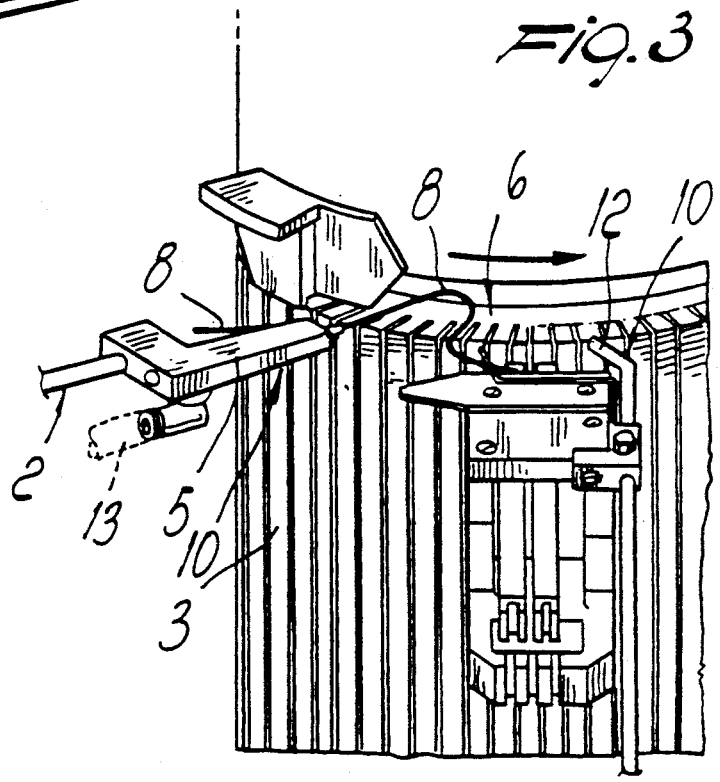
FIG. 3 is a perspective view of the process step illustrated in FIG. 2.

In order to form the design, a preset number of needles 7 is excluded from the knitting by means of a known selection device and does not take up the thread fed by the corresponding feed, which remains floating inside the cylinders, i.e. on the reverse side of the stocking. The thread guide 2 is moved from its inoperative position to the operative position (FIGS. 2 and 3), and the first nozzle 11 is actuated, directing the thread 8 towards the inside of the needle cylinders 3 so as to allow said thread 8 to be gripped by the group of needles 7 which is moved to knit proximate to the thread guide 2 by means of known selection devices.

Figure 4:
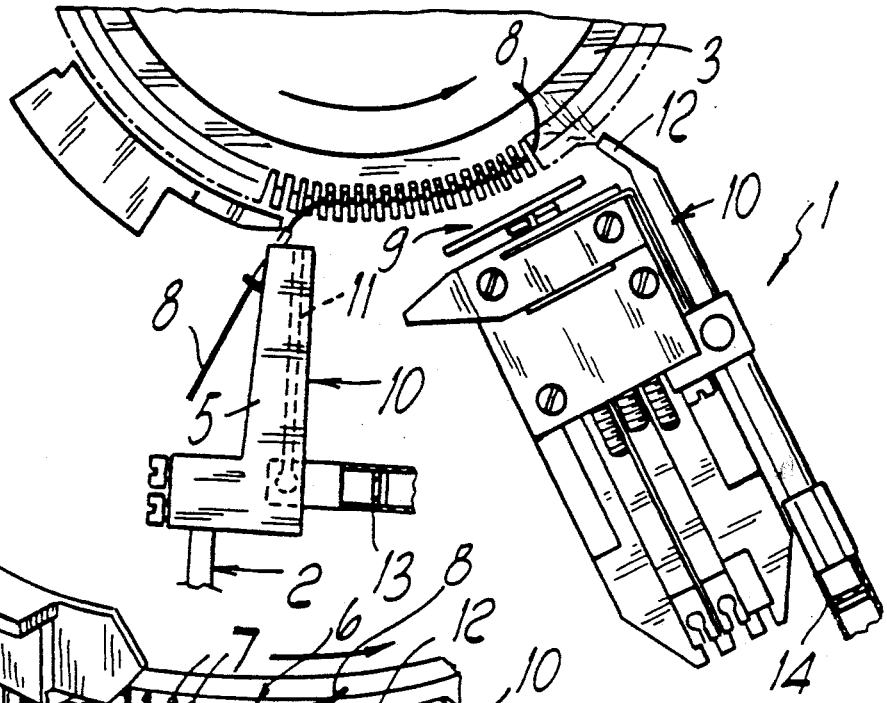
FIG. 4 is a view, similar to FIG. 1, illustrating the knitting of a row of the design.
Figure 5:
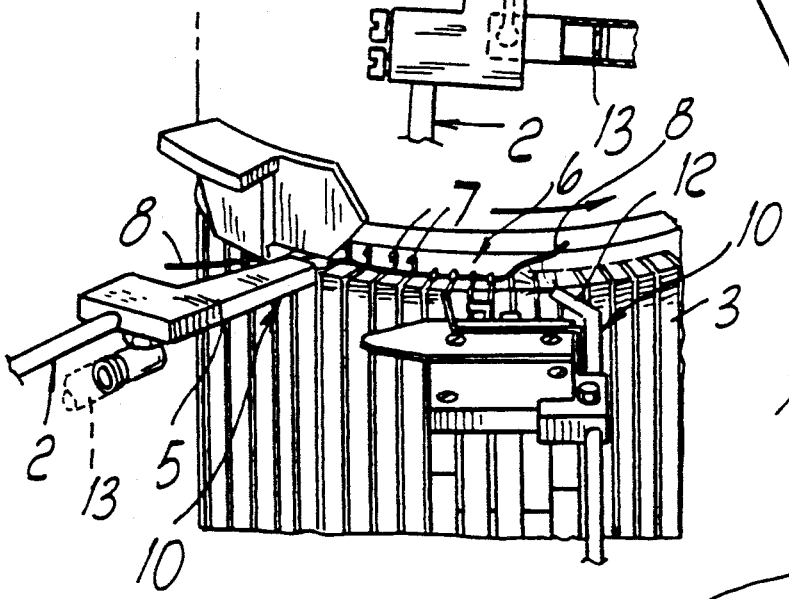
FIG. 5 is a perspective view of the process step illustrated in FIG. 4.

After the thread 8 has been gripped by the needles 7, the machine knits a row of the design to be produced, and the cutting and retention means 9 release the free end of the thread 8, which is moved towards the inside of the cylinders 3 by a jet of air delivered by the second nozzle 12 when said thread becomes located proximate to said nozzle (FIGS. 4 and 5) by virtue of the rotation of the cylinders 3.

Figure 6:
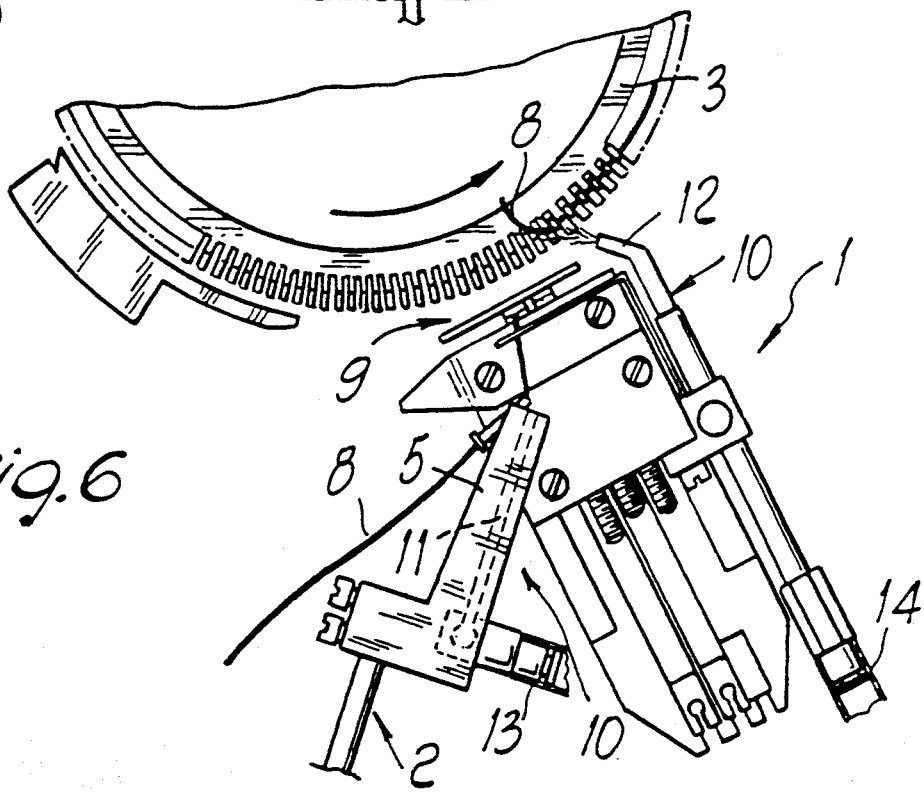
FIG. 6 is a view, similar to FIG. 1, illustrating the final process step of the formation of a row of the design.

Once the portion of the row which forms the design has been completed, the thread guide 2 is again moved to its inoperative position. As an effect of this movement and due to the rotation of the cylinders 3, the thread 8 is again gripped by the cutting and retention means 9 and is cut. The cut end of the thread 8 is pushed towards the inside of the cylinders by the jet of air delivered by the second nozzle 12 (FIGS. 6 and 7).

The operation described heretofore is repeated until the design is completed; upon every turn of the needle cylinder, the number of needles which knit the thread 8 instead of the thread used for the remaining part of the stocking may vary according to the design to be produced.

If due to design requirements one or more rows must provide an interruption which affects a small number of stitches, the thread 8 may be kept floating on the inner side, i.e. on the reverse side of the stocking, for these stitches.

FIG. 8 illustrates by way of example a portion of stocking 15 with a design 16 produced with the process according to the invention.

The portion of stocking 17 not affected by the design may be produced conventionally with decorations 18 obtained for example by purl stitches alternated with plain stitches, typical of stockings manufactured with a twin-cylinder machine. The design is constituted by row portions 19 knit with a thread differing in color with respect to the thread used for the remaining part of the stocking. The ends of the thread used for the design are not visible on the outer side of the stocking, since as mentioned they are moved to its inner side during its production. In a region 20, the portions of row which form the design have an interruption which is obtained, as mentioned, by keeping the thread 8 used to produce the design floating on the inner side of the stocking. One or more designs, located in various regions of the stocking, may be produced according to requirements.

As previously mentioned, the thread used for the remaining part of the stocking floats on the inner side of said stocking at the designs.

In practice it has been observed that the process according to the invention fully achieves the intended aim, since it allows to perform in a simple manner various kinds of design directly during the forming of the stocking using twin-cylinder circular knitting machines.

Another advantage of the process according to the invention is that it can be carried out with a device which can be mounted in a simple manner on a conventional twin-cylinder circular knitting machine in addition to the existing thread guides.

The process according to the invention and the device for executing it are susceptible to numerous modifications and variations, all of which are within the scope of the inventive concept; all the details may furthermore be replaced with technically equivalent elements.

In practice, the materials employed, as well as the dimensions, may be any according to the requirements and to the state of the art.

I claim:

1. A device for producing designs on stockings in twin-cylinder circular knitting machines of the type having needle cylinders defining an annular periphery, said device comprising;

thread guide means controllably movable in a radial direction with respect to needle cylinders in a twin-cylinder circular knitting machine, said thread guide means positioned at an inoperative position located remote from said needle cylinders, and movable radially inwardly to at least one operative position located proximate to said needle cylinders for feeding a first thread to a preset number of needles for forming a design;

means for retaining and cutting a first thread located downstream of said thread guide means with respect to a direction of rotation defined by said needle cylinders, means for delivering a jet of air located proximate to said thread guide means and said means for retaining and cutting, said means for delivering being controllably actuatable for conveying free ends of a portion of a first thread knit by said preset number of needles towards a position overlying at least one of said needle cylinders, wherein said thread guide is selectively movable between said operative position and said inoperative position outside said annular periphery defined by said needle cylinders.

2. Device according to claim 1, wherein said thread guide means comprise;

a thread guide controllably movable in a radial direction with respect to said needle cylinder, and a thread delivery end defined by said thread guide, wherein said inoperative position is defined by said thread guide when said thread delivery end is located outside of and remote from said annular periphery of said needle cylinders.

3. Combination according to claim 2, wherein said means for delivering a jet of air comprise at least one first delivery nozzle, said first delivery nozzle being located at said thread delivery end of said thread guide and oriented substantially radially with respect to said needle cylinders when said thread guide is in said operative position.

4. Combination according to claim 2, wherein said means for delivering a jet of air comprise at least one first delivery nozzle and at least one second delivery nozzle, said first delivery nozzle being located at said thread delivery end of said thread guide and oriented substantially radially with respect to said needle cylinders when said thread guide is in said operative position, said second delivery nozzle being located proximate to said means for retaining and cutting a first thread.

5. In combination, a twin-cylinder circular knitting machine and a device for producing designs on stockings, said twin cylinder circular machine comprising;

needle cylinders defining a direction of rotation, a plurality of needles carried by said needle cylinders, a preset number of needles defined by said plurality of needles, said preset number of needles being feedable with a first thread for forming a design, a needle work area defined by said plurality of needles, an external annular periphery defined by said needle cylinders, an inside area of said needle cylinders defined within said external annular periphery, said device for producing designs comprising;

a thread guide controllably movable in a radial direction with respect to said needle cylinder, a thread delivery end defined by said thread guide, an inoperative position defined by said thread guide when said thread delivery end is located remote from said needle work area outside said annular periphery of said needle cylinders, and an operative position defined by said thread guide when said thread delivery end is located proximate to said needle work area and proximate to said annular periphery of said needle cylinders for feeding a first thread to said preset number of needles for forming a design;

wherein said thread guide is selectively movable between said operative position and said inoperative position outside said annular periphery of said needle cylinders, said device further comprising;

means for retaining and cutting a first thread located downstream of said thread guide with respect to said direction of rotation defined by said needle cylinders, means for delivering a jet of air located proximate to said thread delivery end of said thread guide and said means for retaining and cutting, said means for delivering being controllably actuatable for conveying free ends of a portion of a first thread knit by said preset number of needles towards said inside area defined within said external annular periphery of said needle cylinders.

6. Combination according to claim 5, wherein said means for delivering a jet of air comprise at least one first delivery nozzle, said first delivery nozzle being located at said thread delivery end of said thread guide and oriented substantially radially with respect to said needle cylinders when said thread guide is in said operative position.

7. Combination according to claim 5, wherein said means for delivering a jet of air comprise at least one first delivery nozzle and at least one second delivery nozzle, said first delivery nozzle being located at said thread delivery end of said thread guide and oriented substantially radially with respect to said needle cylinders when said thread guide is in said operative position, said second delivery nozzle being located proximate to said means for retaining and cutting a first thread.

8. In combination, a twin-cylinder circular knitting machine and a device for producing designs on stockings, said twin cylinder circular machine comprising;

needle cylinders defining a direction of rotation, a plurality of needles carried by said needle cylinders, a preset number of needles defined by said plurality of needles, said preset number of needles being feedable with a first thread for forming a design, a needle work area defined by said plurality of needles, an external annular periphery defined by said needle cylinders, an inside area of said needle cylinders defined within said external annular periphery, said device for producing designs comprising;

a thread guide controllably movable in a radial direction with respect to said needle cylinder, a thread delivery end defined by said thread guide, an inoperative position defined by said thread guide when said thread delivery end is located remote from said needle work area outside said annular periphery of said needle cylinders, and an operative position defined by said thread guide when said thread delivery end is located proximate to said needle work area and proximate to said annular periphery of said needle cylinders for feeding a first thread to said preset number of needles for forming a design;

wherein said thread guide is selectively movable between said operative position and said inoperative position outside said annular periphery of said needle cylinders, said device further comprising;

means for retaining and cutting a first thread located downstream of said thread guide with respect to said direction of rotation defined by said needle cylinders, and means for delivering a jet of air comprising;

at least one first delivery nozzle located at said thread delivery end of said thread guide and oriented substantially radially with respect to said needle cylinders when said thread guide is in said operative position, and at least one second delivery nozzle located proximate to said meand for retaining and cutting a first thread, wherein said means for delivering a jet of air are controllably actuatable for conveying free ends of a portion of a first thread knit by said preset number of needles towards said inside area defined within said external annular periphery of said needle cylinders.

9. Process for producing designs on stockings in twin-cylinder circular knitting machines of the type having needle cylinders defining an annular periphery and bearing a plurality of needles, defining a needle work area and including preset number of needles selectable for pattern formation, said process comprising the steps of;

providing a thread guide for a first thread, placing said thread guide in an inoperative position located remote from said needle work area outside said annular periphery of said needle cylinders, feeding a second thread constituting a stocking, moving said thread guide from said inoperative position to an operative position located proximate to said needle work area and outside said annular periphery of said needle cylinders for feeding a first thread to said preset number of needles for forming a design;

feeding said first thread to said preset number of needles by means of said thread guide, said first thread differing in color with respect to said second thread constituting said stocking, providing cutting means, placing said cutting means at a position located outside said annular periphery of said cylinders, cutting said first thread proximate to ends of a portion of a row knit by said preset number of needles.

10. Process according to claim 9, further comprising the intermediate steps of;

generating a first air-flow;

blowing a free end of said first thread fed by means of said first flow of air after having moved said thread guide to said operative position, whereby to cause said first thread to be picked-up and worked by said preset number of needles alternatively to said second thread during formation of a row of knitting.

11. Process according to claim 10, further comprising the intermediate steps of;

providing thread cutting and retention means, gripping a free end of said first thread with said cutting and retention means when said thread guide is located at said inoperative position, and releasing a free end of said first thread from said cutting and retention means upon moving said thread guide to said operative position.

12. Process according to claim 9, further comprising the intermediate steps of;

providing thread cutting and retention means, gripping a free end of said first thread with said cutting and retention means when said thread guide is located at said inoperative position, and releasing said free end of said first thread from said cutting and retention means upon moving said thread guide to said operative position, generating a first air-flow;

blowing said free end of said first thread fed by means of said first flow of air after having moved said thread guide to said operative position, whereby to cause said first thread to be picked-up and worked by said preset number of needles alternatively to said second thread and forming of a row of knitting with said preset number of needles, retaining and cutting the first thread constituting a design portion at a position proximate to ends of said row knit by said preset number of needles, whereby to provide a cut end, generating a second flow of air, blowing said cut end radially inwardly towards the needle cylinders by means of said second flow of air proximate to a position whereat the first thread is retained and cut.

13. Process according to claim 9, further comprising the intermediate step of maintainig said second thread in a floating condition internally of said needle cylinders during said step of feeding said first thread to said preset number of needles for forming a design.

* * * * *